US011486347B2

(12) United States Patent
Akbayir

(10) Patent No.: US 11,486,347 B2
(45) Date of Patent: Nov. 1, 2022

(54) METHOD AND DEVICES FOR OBTAINING ENERGY FROM THE EARTH'S GRAVITATIONAL FORCE, AND DEVICE FOR INTRODUCING A WORKING BODY INTO A LIQUID

(71) Applicant: AKBAYIR HOLDING UG, Beerfelden (DE)

(72) Inventor: Zeki Akbayir, Beerfelden (DE)

( * ) Notice: Subject to any disclaimer, the term of this patent is extended or adjusted under 35 U.S.C. 154(b) by 0 days.

(21) Appl. No.: 16/595,439

(22) Filed: Oct. 7, 2019

(65) Prior Publication Data

US 2020/0032765 A1 Jan. 30, 2020

Related U.S. Application Data

(62) Division of application No. 15/561,582, filed as application No. PCT/DE2015/200193 on Mar. 26, 2015, now Pat. No. 10,465,649.

(51) Int. Cl.
*F03B 17/02* (2006.01)
*F03B 17/04* (2006.01)

(52) U.S. Cl.
CPC ..... *F03B 17/02* (2013.01); *F03B 17/04* (2013.01)

(58) Field of Classification Search
CPC ..... F03B 17/02; F03B 17/025; F03B 17/04
See application file for complete search history.

(56) References Cited

U.S. PATENT DOCUMENTS 3,857,242 A * 12/1974 Gilmore ..... F03B 17/04 60/495
6,249,057 B1 6/2001 Lehet
7,134,283 B2 11/2006 Villalobos
8,756,932 B2 * 6/2014 Pirincci ..... H02K 53/00 60/496
2007/0000246 A1 * 1/2007 Prastitis ..... F03B 17/025 60/504

(Continued)

FOREIGN PATENT DOCUMENTS

DE 3816133 A1 12/1989
DE 3909154 A1 10/1990

(Continued)

OTHER PUBLICATIONS

International Search Report for PCT/DE2015/200193 dated Feb. 12, 2016.

(Continued)

*Primary Examiner* — Mark A Laurenzi
*Assistant Examiner* — Xiaoting Hu
(74) *Attorney, Agent, or Firm* — McDonnell Boehnen Hulbert & Berghoff LLP

(57) ABSTRACT

The invention relates to a method for obtaining energy from the Earth's gravitational force, in particular for producing a rotational movement, which method is designed in such a way that working bodies are introduced into a liquid column or into communicating liquid columns by introducing devices, the action of which is oriented toward one another, counter to the water pressure, in such a way that the force/energy needed for the introduction into the (one) liquid column is at least partly compensated by a force/energy resulting from the same or other liquid column. A device for producing rotational movement uses the method according to the invention.

8 Claims, 5 Drawing Sheets

(56) References Cited

U.S. PATENT DOCUMENTS

| | | | | |
|---|---|---|---|---|
| 2009/0252563 | A1 | 10/2009 | Gillespie | |
| 2009/0309373 | A1* | 12/2009 | O'Briant | H02K 53/00 290/1 R |
| 2010/0031651 | A1* | 2/2010 | Spataro | F03B 17/02 60/495 |
| 2014/0196450 | A1* | 7/2014 | Boyd | F03B 17/04 60/495 |

FOREIGN PATENT DOCUMENTS

| | | | |
|---|---|---|---|
| DE | 202013009283 | U1 | 1/2014 |
| WO | 2007007114 | A1 | 1/2007 |
| WO | 2008095274 | A1 | 8/2008 |

OTHER PUBLICATIONS

International Preliminary Report on Patentability for PCT/DE2015/200193 dated Sep. 26, 2017.

* cited by examiner

METHOD AND DEVICES FOR OBTAINING ENERGY FROM THE EARTH'S GRAVITATIONAL FORCE, AND DEVICE FOR INTRODUCING A WORKING BODY INTO A LIQUID

CROSS REFERENCE TO RELATED APPLICATIONS

This application is a divisional of U.S. application Ser. No. 15/561,582 filed Sep. 26, 2017, which is a U.S. National Phase Application pursuant to 35 U.S.C. § 371 of International Application No. PCT/DE2015/200193 filed Mar. 26, 2015. The entire disclosure contents of these applications are herewith incorporated by reference into the present application.

FIELD

The present invention relates to a method for obtaining energy from the earth's gravitational force, in particular to generate a rotational movement, wherein working bodies are introduced into a liquid column or into communicating liquid columns via introducing devices, oriented such that they act in complementary directions, counter to the water pressure, such that the force/energy necessary for introducing them into the (one) liquid columns is compensated for, at least in part, by a force/energy resulting from the same or other liquid columns. Moreover, the invention relates to a corresponding device for obtaining energy from the earth's gravitational force, in particular for executing this method.

Furthermore, the present invention relates to a method for obtaining energy from the earth's gravitational force, which combines and operatively connects two introducing devices, oriented mirror-symmetrically to one another in order to introduce working bodies in an alternating manner into corresponding liquids, counter to the water pressure of the liquid columns, in particular for subsequent use of the buoyancy of the working bodies, e.g. to generate a rotational movement, in a suitable manner, such that the potential energy of the liquid bearing on the two outer regions or outer surfaces of the introducing devices is used, via a hydraulic or mechanical connection of the inner regions or inner surfaces of the two introducing devices, to support and minimize the energy necessary for insertion by the respective opposing introducing devices, counter to the potential energy of the liquid columns. The two introducing devices coupled and communicating via a hydraulic and/or mechanical system, are configured such that with little additional energy that is to be fed into the system in the form of a support by the alternating insertion movement, the hydraulic connection of the two introducing devices is created in these hollow spaces counter to the liquid pressure exerted by the outer liquid columns, by means of which working bodies can be inserted into the liquid columns for the purpose of obtaining energy. The height of the liquid columns is irrelevant to the functioning of the method with the introducing devices described below. The height of the abutting liquid columns and the size and number of working bodies that are used can be selected arbitrarily.

The introducing devices, disposed such that they are mirror-symmetrical, coupled at their respective inner regions or at their respective inner surfaces via a hydraulic or mechanical system, combined with two containers disposed on the respective outer surfaces, ideally likewise having the same construction, both of which are filled with a liquid, preferably water, collectively form a device and enable a method for generating a rotational movement through using the buoyancy and gravity of working bodies. Each of the corresponding liquid containers contains one buoyancy conveyor having revolving receiving elements for a working body buoyed upward from a lower region of the liquid into an upper region of the liquid, wherein a gravitational conveyor operatively connected to the buoyancy conveyor having revolving receiving elements for working bodies is disposed outside the liquid, and wherein a working body buoyed into the upper region by a receiving element of the buoyancy conveyor, is moved by means of an output to a receiving element of the gravitational conveyor in order to be transported to a lower region of the liquid, where the working body is introduced into the lower region of the liquid by means of the introducing device, to be received by a receiving element of the buoyancy conveyor and to float upward in the liquid, such that both of the respectively coupled buoyancy and gravitational conveyors are rotationally driven through buoyancy and gravitational forces.

BACKGROUND

A device and a method for generating a rotational movement of the type specified in the introduction, but for just one single container, are known from DE 39 09 154 C2. With the known device, a buoyancy conveyor 3 is disposed in a container 1, which is filled with a liquid 2. The buoyancy conveyor 3 has revolving receiving elements 7 for working bodies 9 floating upward in the liquid from a lower region of the liquid into an upper region of the liquid. A gravitational conveyor 19 having revolving receiving elements 23 for working bodies 9, operatively connected to the buoyancy conveyor 3, is disposed outside the liquid. A working body buoyed upward into the upper region of the liquid 2 is moved from a receiving element 7 of the buoyancy conveyor 3 by means of an output 10, 11 to a receiving element 23 of the gravitational conveyor 19, for transport to a lower region of the liquid 2. The working body 9 is introduced there into the lower region of the liquid 2 by means of an intake 13, to be received by a receiving element 7 of the buoyancy conveyor 3, and to float upward in the liquid 2, such that the buoyancy conveyor is rotationally driven through buoyancy, and the gravitational conveyor is rotationally driven by gravity.

In the known device, the intake 13 is designed as a fluid gate having two fluid gate doors 14 and 15, wherein a working body 9 is moved through the fluid gate door 15 into a fluid gate chamber by means of a piston 25 running through a cylinder 24. From there, the working body 9 enters the lower region of the liquid 2 through the fluid gate door 14.

With the known device, it is problematic that a complicated and ineffective fluid gate operation must be carried out in order to introduce a working body 9 into the liquid 2. With this procedure, first the fluid gate chamber of the intake 13 must be drained of liquid, after which the working body 9 that is to be introduced is inserted into the fluid gate chamber by means of the piston 25. Subsequently, the piston 25 returns to its starting position, and the fluid gate door 15 is closed. The fluid gate chamber 13 is then filled with liquid and the fluid gate door 14 can be opened, in order to allow the working body 9 to float upward. The fluid gate door 14 is then closed again, and the fluid gate chamber 13 is drained in order to receive another working body 9. As a result, with the known device and the known method for generating a rotational movement, numerous components and steps are necessary in order to enable the introduction of the working body into the liquid. This results in a complicated and ineffective generation of the rotational movement.

SUMMARY

The fundamental object of the present invention is therefore to create a method and a device for obtaining energy, a device and a method for generating a rotational movement of the type specified in the introduction, and a device for introducing a working body into a liquid, according to which the generation of a rotational movement is enabled through an efficient introduction of working bodies into a liquid with structurally simple means. The substantial subject matter of the present invention is the device for an alternating introduction of the working bodies by means of an energetically advantageous construction of the at least two introducing devices, disposed mirror-symmetrically.

The above object is achieved by a method according to claim 1, and a corresponding device according to claim 5.

The method according to claim 1 is further designed in a preferred exemplary embodiment, such that the insertion energy, counter to the potential energy of the liquid columns dedicated to the respective opposing introducing devices, is supported and/or minimized via a hydraulic and/or mechanical connection, preferably of the inner regions or inner surfaces, of the introducing devices.

At this point, it should be noted that although the height of the water column(s) defines the performance of the device, it is, however, irrelevant for the introduction of the working bodies, specifically due to the compensation of forces according to the invention.

A further preferred design is characterized in that through the supply of energy, hollow chambers are created in opposition to the liquid pressure exerted by a liquid column, through which hollow chambers, working bodies can be introduced into the liquid columns in an alternating manner, for the purpose of obtaining energy.

In a further advantageous manner, two introducing devices are oriented such that they are mirror-symmetrical to one another.

The above object is furthermore achieved by a device for generating a rotational movement having the features of claim 6, by a method for generating a rotational movement having the features of claim 23, and by a device for introducing working bodies into a liquid having the features of claim 18.

Accordingly, the device for generating a rotational movement according to claim 6 is configured and further developed such that a second container, likewise filled with liquid and spaced apart from the first container, which has second buoyancy and gravitational conveyors corresponding to the first buoyancy and gravitational conveyors and operationally connected in the same manner, and has a corresponding output and a corresponding introducing device for working bodies, is disposed such that the second buoyancy and gravitational conveyors are rotationally driven in the same manner as the first buoyancy and gravitational conveyors through buoyancy and gravity, and in that a drive piston is disposed between the first and second containers, which controls the two introducing devices through a back and forth movement, in order to introduce the working bodies into the liquid of the first container and into the liquid of the second container in an alternating manner.

Moreover, the method for generating a rotational movement according to claim 23 is designed and further developed such that the second container, spaced apart from the first container and likewise filled with liquid, which has second buoyancy and gravitational conveyors corresponding to the first buoyancy and gravitational conveyors, and operationally connected in the same manner, and which has a corresponding output and a corresponding intake for working bodies, is disposed such that the second buoyancy and gravitational conveyors are rotationally driven by buoyancy and gravity in the same manner as the first buoyancy and gravitational conveyors, and in that the two introducing devices are controlled by a back and forth movement of a drive unit disposed between the first and second containers, in particular having a drive piston, for an alternating introduction of the working bodies into the liquid of the first container and the liquid of the second container.

Furthermore, a device for introducing a working body into a liquid, in particular in a device for generating a rotational movement according to any of the claims 6 to 17, having an introducing device that can be controlled by means of a drive piston, is defined according to claim 18, wherein the introducing device has a fluid gate with a housing, and has a chamber disposed in the housing that can be displaced in the housing with the drive piston, which receives the working body during the introduction of the working body into the liquid.

In a manner according to the invention, it has been determined that through the combination of the already known device for generating a rotational movement by means of a single container having buoyancy and gravitational conveyors with at least a second, preferably hydraulically corresponding, preferably structurally identical container, thus likewise having buoyancy and gravitational conveyors, or alternatively, the use of a single container that has two connections with the same potential energy level in relation to the outer surfaces of the two introducing devices facing toward the liquid, and the appropriate coupling of the two containers, preferably by means of a piston hydraulics system, and the use of two introducing devices, which are configured in a structurally advantageous manner for the purpose of minimizing the insertion energy necessary for inserting the working bodies into the containers counter to the water pressure exerted thereon, are configured and operationally connected such that the objectives specified above are achieved in a surprisingly simple manner.

The coupling of the containers is achieved via a drive unit moving back and forth between the first and second containers, which controls the introducing devices of the first and second containers for an alternating introduction of the working bodies into the liquid of the first container and into the liquid of the second container. The movement of the drive unit can be used in a particularly efficient manner, through this back and forth movement of the drive unit and the control of the two introducing devices associated therewith, specifically the introducing device for the first container and the introducing device for the second container, in order to minimize the insertion energy needed to insert the working bodies into the containers counter to the water pressure exerted thereon. In concrete terms, the forward movement of the drive unit causes the introduction of a working body into the first container, and a return movement of the drive unit causes a working body to be introduced into the second container. As a result, there is an alternating introduction of the working bodies into the liquid of the first container and into the liquid of the second container, wherein the water pressure of the respective other container energetically supports the introduction of the working body by means of the introducing devices of the fluid gate momentarily introducing a working body. In this manner, a maximum reduction of the energy input into the system, necessary for the drive pistons, is obtained.

Consequently, with the method according to the invention and the device according to the invention, for obtaining energy from the earth's gravitational force through alternating introductions of working bodies into corresponding liquid containers, a device and a method are defined, according to which a particularly efficient possibility is given for using the buoyancy and gravity of the working bodies, e.g. for generating a rotational movement.

The at least two corresponding liquid columns of the device, preferably two containers, must be connected in terms of flow via a line extending between the containers. As a result, through the principle of communicating tubes, equal liquid levels and pressures can be obtained in the containers, such that with an appropriate placement of the line, the same pressure must be overcome during the introduction of a working body into the first container and into the second container. In particular with a flow connection of this type between the two containers, the same or a similar liquid, e.g. water, is contained in the first container and in the second container.

In a concrete design, the line can open into the lower regions of the liquid at each end. In a further advantageous manner, the line can be disposed beneath the drive piston.

Regarding an efficient introduction of the working bodies into the liquid, each of the introducing devices can have a fluid gate with a housing and with a fluid gate chamber that is disposed in the housing and can be displaced with the drive piston, which receives the working body during the introduction of the working body into the liquid. The fluid gate chamber can be displaced thereby by means of the hydraulics and the drive piston between a retracted position, i.e. toward the hydraulics, and an extended position, i.e. a position extending into the lower region of the liquid column.

In order to ensure a secure displacing of the fluid gate chamber in the housing, both fluid gate chambers can be coupled to the drive piston via a respective hydraulic and/or mechanical system. The back and forth movement of the drive piston results, in each case, in a correspondingly translated displacement of the fluid gate chambers in the housings of the fluid gates. With a displacement of the one fluid gate chamber toward the liquid, the other fluid gate chamber is moved away from the liquid of the other container at the same time, and vice versa. Thus, a movement of the fluid gate chambers in the housings is obtained, resulting in an alternating introduction of working bodies into the liquid of the first container and into the liquid of the second container.

In order to support the transfer of pressure of the liquid columns, via the hydraulics and the drive piston, to the second, mirror-symmetrically disposed fluid gate chamber, a pressure piston can be disposed in each of the fluid gate chambers, which can be displaced in relation to the respective fluid gate chamber. The movement of the drive piston thus supports and translates both the movement of the pressure piston as well as that of the fluid gate chamber. The displacement of the working bodies takes place in each case through the transporting thereof into the respective active fluid gate chamber. For this, both pressure pistons and both fluid gate chambers can be coupled to the drive piston, in each case via a hydraulic and/or mechanical system. The coupling of the pressure pistons and the fluid gate chambers to the drive piston, and the movement transferred to the fluid gate chambers and pressure pistons through the movement of the drive piston, can take place in each case with different reductions/translations. In other words, the stroke of the movement of the fluid gate chambers can be larger than the stroke of the movement of the pressure piston, such that it executes a relative movement.

The displacement movements of the fluid gate chambers in the respective housings can be delimited, at least at one end of the housing, by the interior space formed by the respective housing. In other words, a movement of the fluid gate chamber directed away from the liquid can take place up to the end of the housing, which basically serves as a stop for the movement of the fluid gate chamber in the housing. In the same manner, a part of the pressure pistons extending out of the fluid gate chambers can be disposed in each case in a region of the housing that preferably delimits a back and forth movement of the pressure piston. This housing region is normally different than the housing region in which the fluid gate chamber moves. Both the region of the housing accommodating the fluid gate chamber, and the region of the housing that accommodates the section of the pressure piston, can preferably have a cylindrical design.

With regard to a secure introduction of the working body into the fluid gate chambers, the housings can each have a closure element that can move between a closed position and an open position, preferably configured as a flap, and the fluid gate chambers can have a corresponding passage, such that the working body can be introduced into the respective fluid gate chamber through the closure element and the passage in the fluid gate chamber. The control of the closure element and the fluid gate chambers can be coordinated thereby, such that the closure element assumes it open position at exactly the point in time when the passage of the fluid gate chamber is in the region of the closure element. At this point in time, there is no liquid inside the fluid gate chambers, or only enough that the working body can pass easily through the closure element and the passage into the interior of the fluid gate chamber. For an advantageous introduction of the working body from the fluid gate chamber into the lower region of the liquid in the container, each of the fluid gate chambers can have a closing mechanism that can move between a closed position and an open position in an end region facing toward the liquid, preferably with one or two fluid gate flaps. The closing mechanism can be controlled thereby, such that it enters the open position at precisely the same point in time when a working body is brought into the region of the closing mechanism. At this point in time, an opening of the fluid gate chamber, and thus a removal of the working boding from the fluid gate chamber, can take place. The removal takes place indirectly thereby, in the sense that directly after a pressure equalization in the fluid gate chambers and the subsequent opening of the fluid gate flaps have taken place, the working body is already located in the lower region of the liquid. Subsequently the fluid gate chamber moves away from the container and the lower region of the liquid, until the fluid gate flaps can close behind the working body, on the side of the working body facing away from the liquid column, on the front side of the pressure piston. The working body is thus located outside the fluid gate, in the lower region of the liquid in the container. While the fluid gate chamber is moved back until the fluid gate flaps are closed, the entire pressure of the liquid column is likewise applied to the pressure piston, which thus briefly transfers the pressure to the hydraulics, and is displaced toward the opposing introducing device. In all other operating states, and at all other operating times, the closing mechanism can be in the closed position, in order to enable a secure introduction of the working body, and subsequently liquid, if necessary, into the fluid gate chambers.

With regard to a secure opening of the closing mechanism, it is advantageous when liquid is present on both sides of the closing mechanism, e.g. on both sides of appropriate fluid gate flaps, and thus the same pressure prevails there. For this, the closing mechanism can have a passage, such that it is possible for the liquid to flow from the respective container into the respective fluid gate chamber at a preferably predefinable flow rate when it is in the closed position. The flow rate can be predefined thereby through an appropriate selection of the size of the passage through the closing mechanism. The passage enables a controlled inflow of liquid into the chamber when the closing mechanism is in the closed position. A chamber that has been drained in order to introduce a working body into the chamber can be filled continuously in an appropriate manner as a result, in order to subsequently enable an easy removal of the working body from the fluid gate chamber into the liquid of the container, after opening the closing mechanism.

With regard to a particularly reliable control of the intakes, the drive piston can be moved back and forth by means of a motor, preferably an electric motor. Operating positions of the drive piston and the intakes caused by the back and forth movement of the drive piston can be obtained in a reproducible manner by means of such a motor driven drive piston.

Depending on the requirements, the working bodies can be made from a solid material or they can be hollow. With regard to a reliable movement of the working body, in both the region of the conveyors as well as in the region of the outputs and introducing devices, the working bodies can be designed in the shape of a barrel. Alternatively, the working bodies can be spherical.

Other shapes are also conceivable.

The present invention also comprises, in addition to a device and a method for generating a rotational movement, a device implicitly belonging thereto for introducing a working body into a liquid, wherein this device can preferably be used in a device and a method for generating a rotational movement of the types described above.

The device for introducing a working body into a liquid has an introducing device that can be controlled by means of a drive piston, wherein the introducing device has a fluid gate with a housing and with a fluid gate chamber disposed in the housing that can be displaced in the housing with the drive piston, which receives the working body when the working body is introduced into the liquid. With regard to the advantages of a device of this type for introducing a working body into a liquid, reference can be made to the description of the device and the method for generating a rotational movement described above, in order to avoid repetition, because such a device for introducing a working body into a liquid is described there.

In an advantageous design of this device, a pressure piston can be disposed in the fluid gate chamber, which can be displaced in relation to the fluid gate chamber with the drive piston as well, wherein a section of the pressure piston extending out of the fluid gate chamber is preferably disposed in a—preferably cylindrical—housing region delimiting a back and forth movement of the pressure piston. In a further advantageous manner, the housing can have a closure element that can move between a closed position and an open position, preferably with a flap, and the fluid gate chamber can have a corresponding passage, such that the working body can be introduced through the closure element and the passage into the fluid gate chamber.

In a further preferred embodiment, the fluid gate chamber can have a closing mechanism in an end region facing the liquid, that can be moved between a closed position and an open position, preferably having one or two fluid gate flaps. The closing mechanism can, further advantageously, have a flow passage, such that when it is closed, a flow of the liquid into the fluid gate chamber is enabled, preferably with a predefinable flow rate.

With regard to the advantages of the embodiments specified above, of the device for introducing a working body into a liquid, reference may likewise be made to the preceding description of a correspondingly designed device for generating a rotational movement, in order to avoid repetition.

BRIEF DESCRIPTION OF THE DRAWINGS

There are now various possibilities for embodying and developing the teachings of the present invention in an advantageous manner. For this, reference is made, on one hand, to the subordinate Claims, and on the other hand to the following explanations of preferred exemplary embodiments of the teachings according to the invention, based on the drawings. In conjunction with the preferred exemplary embodiments of the teachings according to the invention based on the drawings, preferred designs and developments of the teachings shall also be explained in general. In the drawings.

DETAILED DESCRIPTION

Figure 1:
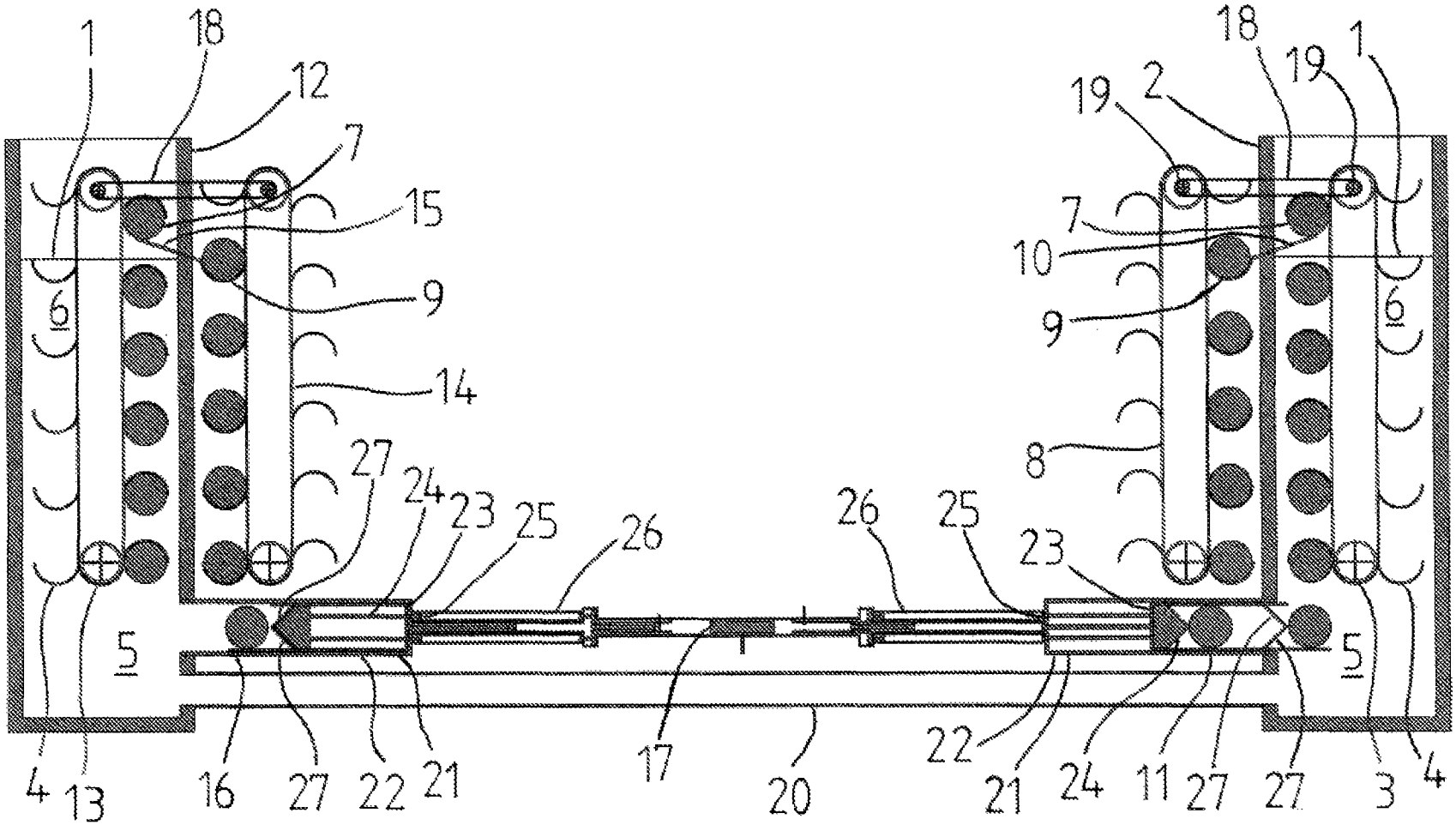
FIG. 1 shows, in a schematic illustration, an exemplary embodiment of a device for generating a rotational movement according to the invention.

FIG. 1 shows, in a schematic illustration, an exemplary embodiment of a device for alternating introductions of working bodies 7 into corresponding liquid containers, in order to use the buoyancy and gravity of the working body 7 to generate a rotational movement, wherein the corresponding liquid containers are formed here, by way of example, as two separate containers, container 2 and container 12, each of which is filled with the same liquid 1.

A first buoyancy conveyor 3 having revolving receiving elements 4 for a working body 7 buoyed upward in the liquid 1 from a lower region 5 of the liquid 1 into an upper region 6 of the liquid is disposed in the liquid 1 of the container 2. The buoyancy conveyor 3 extends somewhat over the upper level of the liquid 1 thereby. A first gravitational conveyor 8 with revolving receiving elements 9 for working bodies 7 is disposed outside of and substantially adjacent to the liquid 1, operationally connected to the first buoyancy conveyor 3. The operational connection between the first buoyancy conveyor 3 and the first gravitational conveyor 8 is obtained via a belt 18 or a chain, which synchronizes a continuous revolving movement of the buoyancy and gravitational conveyors 3 and 8. The belt 18 is guided over corresponding axles 19.

A working body 7 buoyed into the upper region 6 is moved from a first receiving element 4 of the first buoyancy conveyor 3 by means of an output 10 to a receiving element 9 of the first gravitational conveyor 8, in order to enable transport thereof to the lower end of the gravitational conveyor 8. The output 10 is configured as a slide in the exemplary embodiment shown here, such that a working body 7 can slide or roll from one receiving element 4 to another receiving element 9, i.e. it takes this path without additional help. After the working body 7 has been received by a receiving element 9, it drives the gravitational conveyor 8 due to the gravity acting on it, and moves thereby to the lower end of the gravitational conveyor 3.

At the lower end of the gravitational conveyor 8, the working body 7 is introduced into the lower region 5 of the liquid 1 by means of an introducing device 11, to be received by a receiving element 4 of the first buoyancy conveyor 3, and to float upward in the liquid 1. In this manner, the first buoyancy conveyor 3 is driven in a rotational manner through buoyancy, and the first gravitational conveyor 8 is driven in a rotational manner through gravity.

In order to significantly reduce the insertion energy required for the effective functioning of the introducing device to introduce the working body 7 into the container 2, a second container 12 is needed, having the same construction and function as the first container 2, which is disposed at a spacing thereto. The container 12 is likewise filled with the same liquid 1, and has second buoyancy and gravitational conveyors 13 and 14, corresponding to the first buoyancy and gravitational conveyors 3, 8, that are constructed in the same manner and operationally connected, and which have a corresponding output 15 and a corresponding introducing device 16 for working bodies 7. The second buoyancy conveyor 13 likewise has receiving elements 4. The second gravitational conveyor 14 has corresponding receiving elements 9. An operational connection between the second buoyancy conveyor 13 and the second gravitational conveyor 14 is likewise obtained by means of a belt 18. The receiving elements 4 and 9 are designed such that they can advantageously accommodate the respective shape of the working bodies 7.

The containers 2 and 12 are have substantially the same construction, and are ideally disposed mirror-symmetrically.

A drive piston 17 is disposed between the first container 2 and the second container 12, which controls the two introducing devices 11 and 16 through a back and forth movement, which causes an alternating introduction of the working bodies 7 into the liquid 1 of the first container 2 and into the liquid 1 of the second container 12. This assembly allows for the reciprocal use of the water pressure in the containers 2 and 12, which acts on the fluid gate chambers 23, the fluid gate flaps 27, and briefly, during the opening of the fluid gate flaps 27, on the pressure piston 24 as well. The working bodies 7 are introduced into the lower regions 5 of the two containers 2 and 12.

The containers 2, 12, are connected in terms of flow via a line 20 extending between the two containers 2, 12, wherein the line 20 is disposed below the drive piston 17, and opens at each end into the lower region 5 of the liquid 1 in the first container 2 and in the second container 12. As a result, the levels of the liquid 1 in the first container 2 and in the second container 12 are the same at every point in time of the movement of the piston in the drive piston 17.

The introducing devices 11, 16 each have a fluid gate 21 with a housing 22. A fluid gate chamber 23 is disposed in the housing 22, which can be displaced with the drive piston via a hydraulic or mechanical translation. The fluid gate chamber 23 accommodates the working body 7 during the introduction of the working body 7 into the liquid 1. The introducing devices 11 and 16 are basically designed such that they are mirror-symmetrical in relation to the drive piston 17, which is located in the middle, between the introducing devices 11 and 16. A pressure piston 24 is disposed in each of the fluid gate chambers 23, which can likewise be displaced with the drive piston 17, and in relation to the respective fluid gate chamber 23. The pressure piston 24 primarily transfers the pressure of the liquid 1 in the containers 2 and 12 to the hydraulic translation. In concrete terms, the pressure piston 24 extends through the housing 22 and into the fluid gate chamber 23 disposed in the housing 22. The fluid gate chamber 23 that can be displaced in the housing 22 is thus basically disposed between the housing 22 and the pressure piston 24.

Both the fluid gate chamber 23 as well as the pressure piston 24 are each coupled by means of a combination comprising a hydraulic system and a mechanical system to the drive piston 17, wherein the displacement of the fluid gate chamber 23 and the pressure piston 24 takes place in a respective housing 22 with different translations/reductions. In other words, the fluid gate chamber 23 travels a greater distance in its back and forth movement in the housing 22 than a pressure piston 24 in its back and forth movement in relation to the housing 22. As a result of this difference, a hollow space is opened in the fluid gate chamber 23 when the fluid gate chamber 23 is displaced in relation to the pressure piston 24 toward the container 2, into which the working body 7 can then be introduced.

A hydraulic cylinder 26 extends in each case between the drive piston 17 and the respective housing 22, into which the piston rod 25 of the respective pressure piston 24 extends. This hydraulic cylinder 26 is preferably cylindrical, and forms a stop for a movement of the pressure piston 24 toward the liquid 1.

The housings 22 each have a closure element 33 that can be moved between a closed position and an open position, preferably in the form of a flap. Moreover, the fluid gate chambers 23 have a corresponding passage 38, such that the working body 7 can be introduced into the respective fluid gate chamber 23 through the closure element 33 and the passage 38. The closure element 33 is preferably located in the proximity of the receiving element 9 of the gravitational conveyor 8 or 14, respectively, that transports the working body 7 downward. The introduction of the working body 7 into the respective fluid gate chamber 23 takes place in an operating state, in which the closure element 33 of the housing 22 is open, and the fluid gate chamber 23 is in a displacement position in which the passage 38 of the fluid gate chamber 23 is aligned with an opening in the housing 22 formed by the open closure element 33. In this operating position, a working body 7 can be introduced into the fluid gate chamber 23 from outside the housing 22.

To remove the working body 7 from the fluid gate chamber 23 into the lower region 5 of the liquid 1, the fluid gate chambers 23 each have a closing mechanism disposed in an end region of the fluid gate chambers 23 facing the liquid 1, which can be moved between a closed position and an open position, preferably having two pivotable fluid gate flaps 27. The fluid gate flaps 27 form a seal of the fluid gate chamber 23 against the liquid 1 when in the closed position. In this closed position, a working body 7 can be introduced into the fluid gate chamber 23. The collective pressure of the liquid 1 bears on the fluid gate chamber 23 when the fluid gate flaps 27 are closed, and the pressure piston 24 is then subjected to pressure. The closing mechanism having the fluid gate flaps 27 also has a passage 34, shown in FIGS. 3 to 5, such that in this closed position, the liquid 1 can flow at a predefined rate into the respective fluid gate chamber 23. The fluid gate chamber 23 is continuously filled with liquid 1 through this passage 34, after the working body 7 has been introduced into the fluid gate chamber 23, and, optionally, also during and/or briefly prior to this introduction, such that the fluid gate chamber 23 is completely filled with liquid 1 shortly before opening the fluid gate flaps 27, a pressure equalization is obtained, and as a result, a pivoting of the fluid gate flaps 27 to open the fluid gate chamber 23 and remove the working body 7 in the liquid 1 is enabled, due to pressure equalization that has taken place between the fluid gate chamber 23 and the lower region 5 of the container 2, without an undesired pressure shock. When the fluid gate flaps 27 are open, the fluid gate chamber 23 and the pressure piston 24 move away from the lower region 5 of the liquid 1 and away from the working body 7, until the fluid gate flaps 27 close again behind the working body 7, as soon as they have reached the end surface of the pressure piston 24. After closing the fluid gate flaps 27, both the pressure piston 24 as well as the fluid gate chamber 23 are displaced back toward the lower region 5 of the liquid 1. The fluid gate chamber 23 conveys the working body 7 toward the lower region 5 of the container 2 thereby, because it is located in front of the closed fluid gate flaps 27. The pressure piston 24 extends in this displacement up to its stopping point, formed by the piston rod 25 on the housing 22. Because the fluid gate chamber 23 is displaced further than the pressure piston 24, a hollow space is formed in the fluid gate chamber 23, into which a further working body 7 can subsequently be introduced. As a result, it is possible to continuously remove and introduce working bodies 7 from the fluid gate chamber 23 into the liquid 1, or into the fluid gate chamber 23, respectively.

The working body 7 is placed in the fluid gate chamber 23 during a movement thereof toward the liquid 1. A removal of the working body 7 from the fluid gate chamber 23 into the liquid 1 takes place indirectly, through a displacement of the fluid gate chamber 23 away from the liquid 1. Advantageously, the upper edge or upper region of the fluid gate chamber 23, at the end of the fluid gate chamber 23 facing the liquid 1—toward the buoyancy conveyor 3, or 13—can be configured such that it slants, at least slightly, upward, such that a working body 7 is moved, due to the buoyancy acting on it, from the fluid gate chamber 23 to the buoyancy conveyor 3 or 13. After the fluid gate chamber 23 and the pressure piston 24 have been driven far enough away from the working body 7, the fluid gate flaps 27 close again. In the position of the fluid gate chamber furthest away from the liquid 1, the pressure piston is in the region of the fluid gate flaps 27 or bears directly on the fluid gate flaps 27, which are in the closed position in this operating state. Subsequently, the fluid gate chamber 23 is moved back toward the liquid 1 by means of the drive piston 17 and supported by the pressure of the second, opposing container, wherein a new working body 7 is introduced into the fluid gate chamber 23 during this movement. The introduction of the working body 7 into the fluid gate chamber 23 takes place in each case at the point in time when the fluid gate chamber 23 has formed a sufficiently large space through relative displacement of the fluid gate chamber 23 in relation to the pressure piston 24, and is closed when the fluid gate chamber 23 is in the displacement position closest to the liquid 1. In this position, the pressure piston 24 is as far as possible from the end of the fluid gate chamber 23 facing away from the liquid 1.

The subsequent movement of the fluid gate chamber 23 away from the liquid 1 first takes place before the pressure piston 24 moves, such that the working body 7 located in the fluid gate chamber 23 is moved toward the fluid gate flaps 27 in relation to the displaced fluid gate chamber by means of the stationary pressure piston 24. Thus, the working body 7 located in the fluid gate chamber 23 does not move during the procedure described above when the system is inert. During this movement of the fluid gate chamber 23 away from the liquid 1, liquid 1 flows in through the passage 34 of the closing mechanism.

After the fluid gate chamber 23 is completely filled with liquid 1, the fluid gate flaps 27 open, and the fluid gate chamber 23, as well as the pressure piston 24, move back away from the lower region 5 of the liquid 1. After the fluid gate flaps 27 close, the working body 7 is removed from the fluid gate. At this point in time, the pressure piston 24 bears on the fluid gate flaps 27 with its end surface. A formation of a hollow space takes place again inside the fluid gate chamber 23, in that the fluid gate chamber 23 is displaced back toward the lower region 5 of the liquid 1 with the fluid gate flaps 27 closed, and the pressure piston 24 travels in this direction until it reaches the stop.

The drive piston, as part of the drive unit 17, is moved back and forth by means of an external energy source, preferably an electric motor, to control the introducing devices 11 and 16. The coupling of the introducing devices 11 and 16 with the drive piston, and more precisely, the fluid gate chambers 23 and the pressure pistons 24 with the drive piston, obtained by means of a hydraulic and mechanical system, facilitates and supports the displacement of the fluid gate chamber 23 to the respective containers 2 and 12, which takes place counter to the liquid pressure generated by the liquid 1 in the containers 2 and 12, due to the liquid pressure generated by the liquid 1 in the respective other container, which is transferred via the overall mechanical and hydraulic system. The force that is to be applied by the electric motor of the drive piston, in order to displace the fluid gate chamber 23 toward a liquid 1 is thus substantially lower than with an assembly having only one container 2, and without a corresponding second container 12. In other words, with the alternating introduction of working bodies 7 into the two containers 2 and 12—due to the coupling of the fluid gate chambers 23 and pressure pistons of both introducing devices 11 and 16—with each introduction of a working body 7 into the liquid 1 of the containers 2 and 12, the introduction and movement of the fluid gate chamber 23 and the pressure piston 24 is supported due to the liquid pressure of the liquid 1 in the respective other container 2 or 12.

Figure 2:
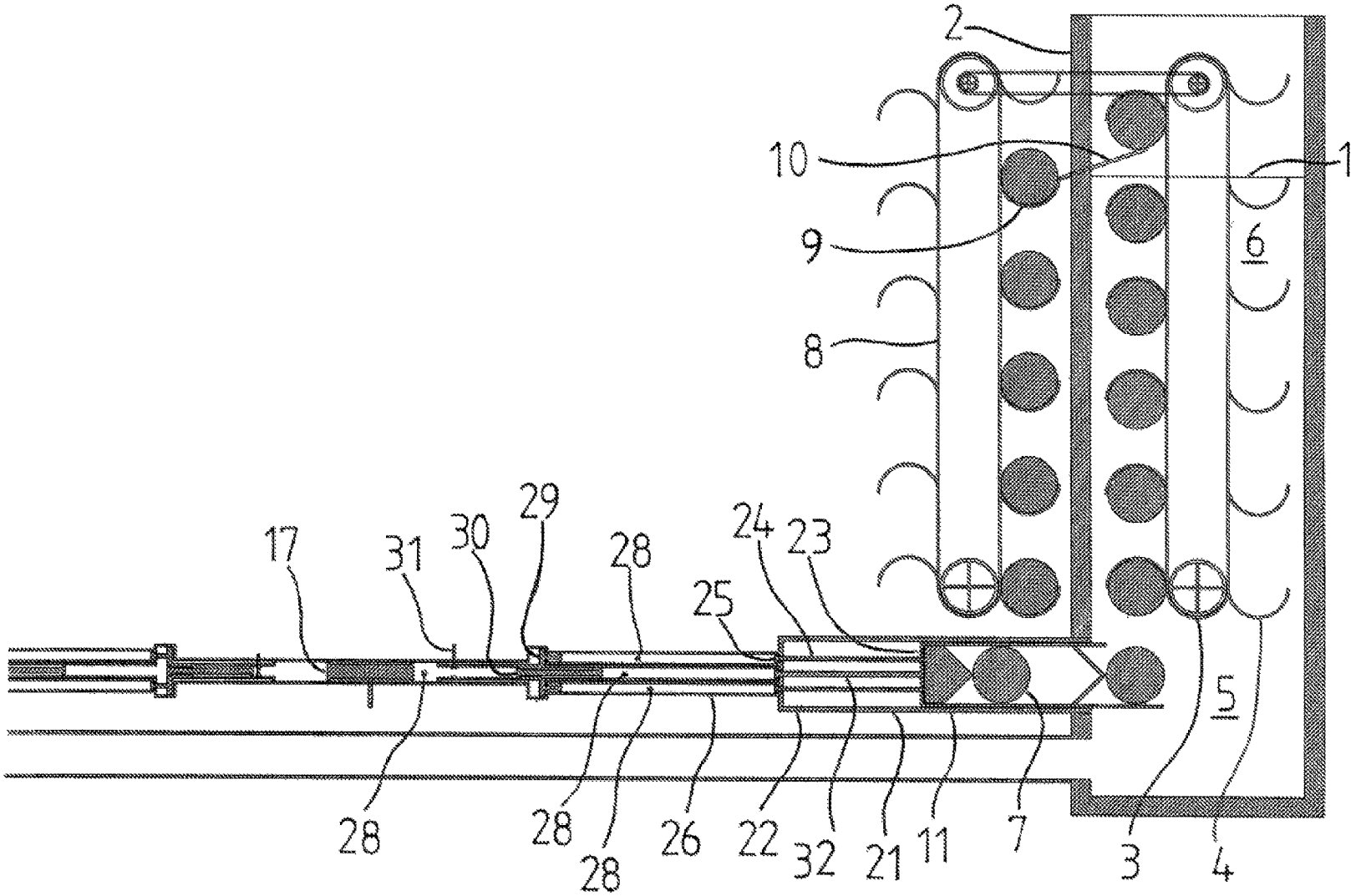
FIG. 2 shows, in a schematic illustration, an enlargement of a part of the exemplary embodiment from FIG. 1.

FIG. 2 shows, in a schematic and enlarged illustration, a section of the device from FIG. 1, wherein the view comprises the container 2. Fundamentally, reference may be made to the detailed description of FIG. 1 for the detailed explanation of FIG. 2, in order to avoid repetition.

In addition to the components and functions already described therein, FIG. 2 shows the coupling of the drive piston 17 to the fluid gate chamber 23 and the pressure piston 24 via a hydraulic fluid 28, and an assembly composed of a large outer piston 29 with a smaller inner piston 30 that can be displaced therein. Moreover, the device has a slider 31, which forms a stop for a movement of the inner piston 30 away from the liquid 1.

FIGS. 1 and 2 show the fluid gate chamber 23 in its position where it has been displaced as close as possible to the liquid 1. Moreover, the pressure piston 24 in FIGS. 1 and 2 is also moved to its position closest to the liquid 1. Accordingly, the pressure piston 24 shown in FIG. 1, and the fluid gate chamber 24 of the introducing device 16 of the second container 12 shown in FIG. 1, are in the position that is furthest away from the liquid 1 of the container 12 in this operating state.

Figure 3:
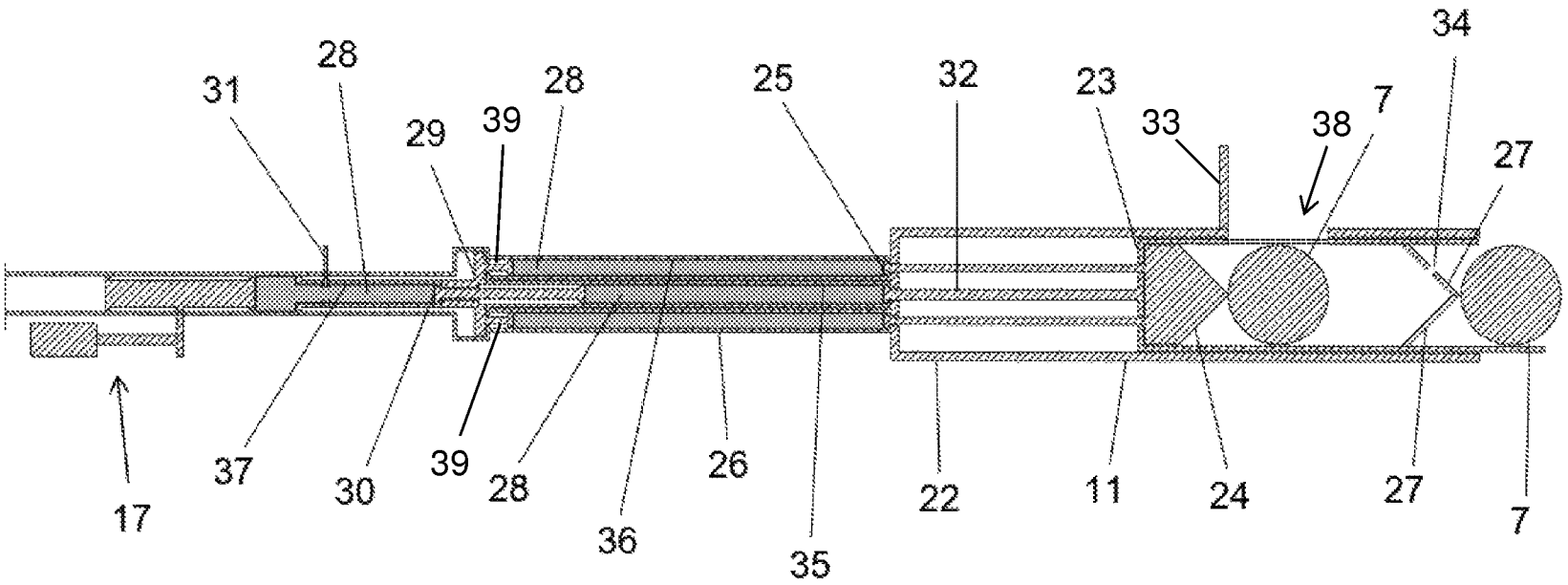
FIG. 3 shows, in a schematic illustration, an enlargement of a section of the intake of the exemplary embodiment from FIG. 1.
Figure 4:
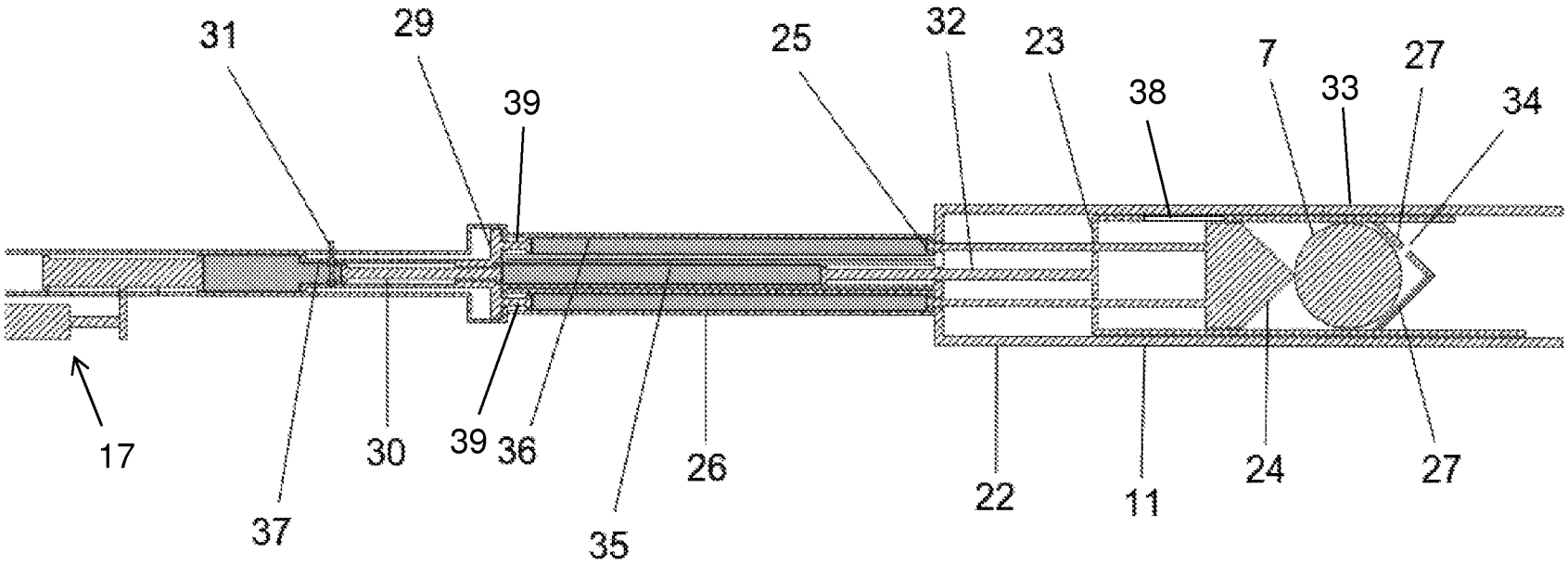
FIG. 4 shows, in a schematic illustration, an enlargement of a section from FIG. 3, in a subsequent operating state.
Figure 5:
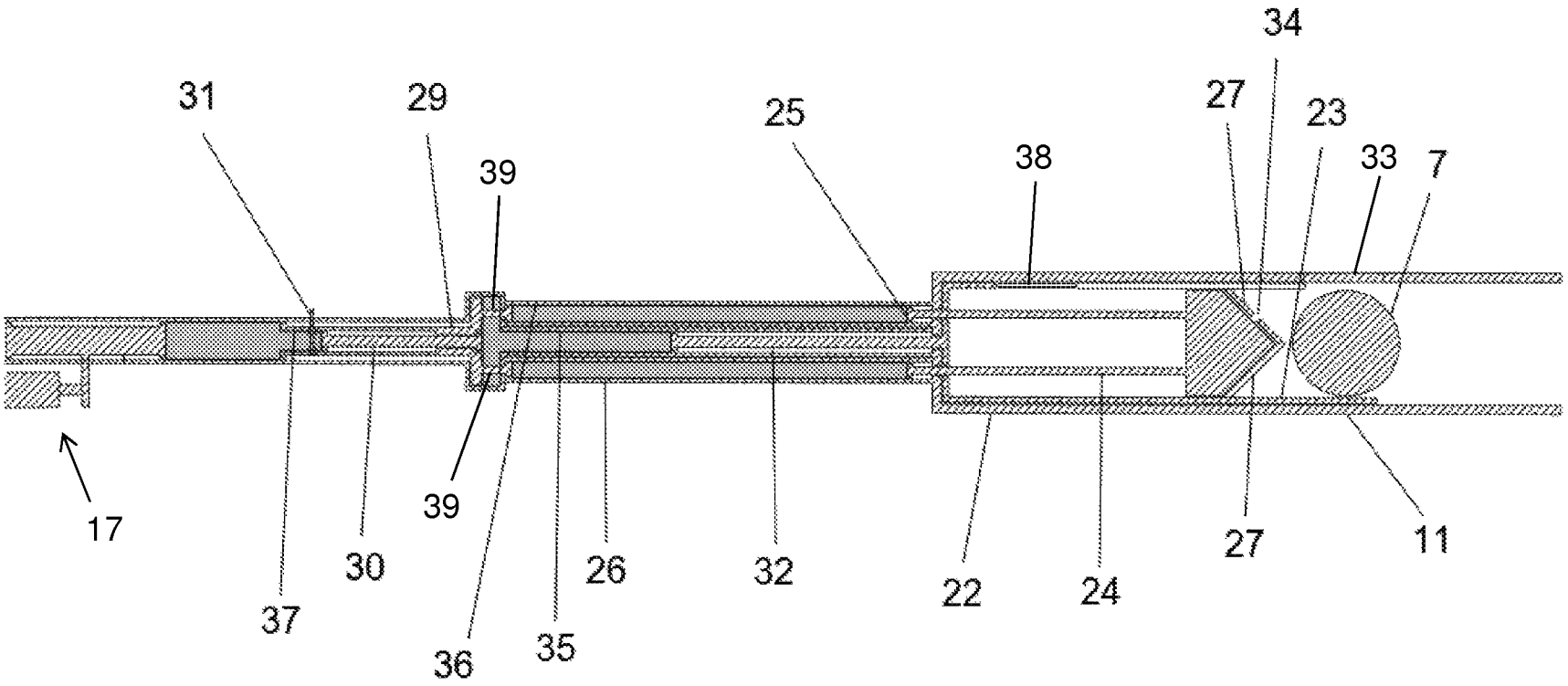
FIG. 5 shows, in a schematic illustration, an enlargement of the section from FIG. 4, in a further, subsequent operating state.

FIGS. 3 to 5 show, in an enlarged depiction, the introducing device 11 of the exemplary embodiment from FIG. 1, in various operating states. FIG. 3 shows the operating state in accordance with FIGS. 1 and 2. The fluid gate chamber 23 and the pressure piston 24 are in their positions, moved furthest out in relation to the housing 22, i.e. closest to the liquid 1 of the container 2. In this operating state, a working body 7 is already located directly in front of the again closed fluid gate flaps 27 in the liquid 1, and another working body 7 is then entirely in the fluid gate chamber 23, wherein it is positioned directly in front of the pressure piston 24. In FIG. 3, the state is shown in which, on one hand, the closure element 33 in the form of a flap on the housing 22 is open, and on the other hand, the passage 38 in the fluid gate chamber 23 for the working body 7 is aligned therewith, such that a working body 7 can be introduced into the fluid gate chamber 23. The closure element 33 and the passage 38 are not shown in FIGS. 1 and 2 for purposes of clarity.

Furthermore, the structure of the region between the drive piston and the housing 22 can be seen clearly in FIGS. 3 to 5. This region has, on one hand, mechanical components, and on the other hand, three separate chambers, each of which is filled with a hydraulic fluid 38, in order to transfer forces from the drive piston to the fluid gate chamber 23 and the pressure piston 24. In concrete terms, two chambers filled with hydraulic fluid 28 are formed in the hydraulic cylinder 26. A substantially cylindrical inner chamber 35 is surrounded by a second outer chamber 36 thereby, which is preferably also cylindrical. The outer chamber 36 is in an operative connection with an outer piston 29 at its piston rod 39, while at the other end, the outer chamber 36 abuts the piston rod 25 of the pressure piston 24. The position of the active surfaces of the piston rods 39 and 25 do not change with respect to the outer chamber 36, while the movement of the active surfaces of the inner chamber 35 can be hydraulically translated on the part of the work piston 17. In order to obtain the relative movement of the pressure piston 24 to the fluid gate chamber 23, the movements of the active surfaces of the inner chamber 35 must be translated by the work piston 17, such that the active surfaces encompass the inner piston 30 and a part of the outer piston 29. Both the pressure piston 24 as well as the fluid gate chamber 23 are displaced thereby, but at different speeds, due to the hydraulic translation—this applies to both directions. If the fluid gate chamber 23 is displaced further toward the liquid column, after the pressure piston 24 has reached its stop, then only the inner piston 30 forms the active surfaces for the hydraulic chamber 35 on the part of the work piston 17. On the other side of the inner chamber 35, the hydraulic fluid 38 is in contact with the piston rod 32 of the fluid gate chamber 23.

A further first chamber 37, filled with hydraulic fluid 28, is formed between the outer piston 29 and the drive piston, into which a slider 31 can be inserted at a predefined section of the outer piston 29, which effectively connects the inner piston and the outer piston 29 in terms of force transfer, when inserted, specifically in the manner of a positive force coupling. When the slider 31 is closed, the inner piston 30 and the outer piston 29 are displaced jointly. The slider 31 is then inserted when the inner piston 30 has been fully inserted into the outer piston 29. When it is displaced toward the working piston 17, both the pressure piston 24 as well as the fluid gate chamber 23 are subjected pressure by the liquid 1, while only the fluid gate chamber 23 is subjected to pressure when it displaced toward the liquid column 1.

FIG. 4 shows an operating state following the operating state in FIG. 3, in which the fluid gate chamber 23 is pushed away from the liquid 1, until it is basically halfway into the housing 22. The pressure piston 24 does not yet move in relation to the stationary housing 22 during this inward movement, but instead, only in relation to the fluid gate chamber 23. As a result, the working body 7 is then directly in front of the still closed fluid gate flaps 27. Both the piston rod 32 of the fluid gate chamber 23, as well as the inner piston 30 are likewise moved toward the drive piston by this, wherein the drive piston also travels a shorter distance from the container 2, due to the translation. In this state, the slider 31 is closed, wherein the inner piston 30 moves toward the drive piston only as far as the slider 31.

In the later operating state shown in FIG. 5, the fluid gate chamber 23 is moved entirely into the housing 22, wherein the fluid gate flaps 27 are briefly opened between the operating states in accordance with FIG. 4 and FIG. 5, in order to remove the working body 7, and subsequently closed. Consequently, the working body 7 is then located outside the chamber 23, initially directly in front of the fluid gate flaps 27, and shortly thereafter, in the lower region 5 of the container 2. At the same time, the pressure piston 24 has moved further in relation to the fluid gate chamber 23, as far as the fluid gate flaps 27. Simultaneous, the pressure piston 24 has moved slightly toward the drive piston in relation to the housing 22. This can be seen at both ends of the piston rods 25 of the pressure piston 24, which have moved away from the housing 22, toward the drive piston. With the movement of the fluid gate chamber 23, the piston rod 32 also moves the fluid gate chamber 23 further toward the drive piston. At the same time, the outer piston 29 moves the same distance as the pressure piston 24 toward the drive piston.

In the operating state shown in FIG. 5, in which the fluid gate chamber 23 is fully moved into the housing 22, the fluid gate chamber 23 of the introducing device 16 of the second container 12 is located at its position where it has been pushed furthest out, and thus toward the liquid 1 of the container 12. During the alternating introduction of the working body 7 into the fluid gate chambers 23 of the introducing devices 11 and 16, the fluid gate chambers 23 move, alternatingly, between a position moved out of the housing 22 and a position in which they are moved into the housing 22. In a corresponding manner, the drive piston moves back and forth between the containers 2 and 12.

In short, the substantial functionality of the system, corresponding to the operating states described above, can be described as follows:

The two introducing devices, disposed mirror-symmetrically, are structurally designed and connected via a hydraulic system, such that fluid gate chambers and pressure pistons can execute both back and forth movements, as well as movements relative to one another, which ultimately make it possible for the working bodies to be introduced into the liquid after the pressure has been equalized during the displacement and after opening the fluid gate flaps. This procedure is supported by the skillfully translated pressure of the respective corresponding liquid columns, which bear on the mirror-symmetrically disposed other introducing device, in particular on its fluid gate chamber, if they are closed, and on the pressure piston if they are open, and is furthermore supported by drive piston that is powered externally by a motor.

With regard to further advantageous designs of the devices according to the invention, and the method according to the invention, reference is made to the general description as well as to the attached Claims, in order to avoid repetition.

Lastly, it should be expressly noted that the exemplary embodiments described above serve only as explanations of the claimed teachings, which are not, however, limited to these exemplary embodiments.

LIST OF REFERENCE SYMBOLS

1 liquid, liquid column
2 first container
3 first buoyancy conveyor
4 receiving element
5 lower region
6 upper region
7 working body
8 first gravitational conveyor
9 receiving element
10 outlet
11 introducing device
12 second container
13 second buoyancy conveyor
14 second gravitational conveyor
15 outlet
16 introducing device
17 drive unit, drive piston
18 belt
19 axle
20 line
21 fluid gate
22 housing
23 fluid gate chamber
24 pressure piston
25 piston rod of the pressure piston
26 hydraulic cylinder
27 fluid gate flap
28 hydraulic fluid
29 outer piston
32 piston rod of the fluid gate chamber
33 closure element, flap
34 passage through the fluid gate flaps
35 inner chamber of the hydraulic cylinder
36 outer chamber of the hydraulic cylinder
37 first chamber of the hydraulic cylinder
38 passage through the fluid gate chamber
39 piston rod of the outer piston

The invention claimed is:

1. A method for generating a rotational movement using the earth's gravitational force, comprising:

introducing working bodies, via a pair of introducing devices acting in opposition to one another, into communicating liquid containers including a first liquid container and a second liquid container, each holding liquid, and counter to a liquid pressure within the liquid containers, such that a force of introduction into one of the liquid containers is at least partially compensated for by a force resulting from the other of the liquid containers minimizing an energy necessary for the introduction, receiving, through an engine driving unit, an energy input at the introducing devices in a range of a portion of the force that is not compensated, and controlling, via a drive piston disposed between the first liquid container and the second liquid container, both introducing devices through a back and forth movement, thereby causing an alternating introduction of the working bodies into the liquid of the liquid containers.

2. The method according to claim 1, further comprising:

supporting the introduction force via a hydraulic connection of inner regions of each of the introducing devices.

3. The method according to claim 1, further comprising:

forming hollow chambers counter to the liquid pressure of a liquid container applied thereto, through which the working bodies are insertable into the liquid containers in an alternating manner.

4. The method according to claim 1, wherein the introducing devices are oriented in mirror-symmetry to one another.

5. The method according to claim 1, wherein the engine driving unit comprises a motor, the drive piston is moved by the motor, and wherein operation of the drive piston is reproducible.

6. The method according to claim 5, wherein the drive piston is provides for reciprocal use of liquid pressure in the first liquid container and the second liquid container.

7. The method according to claim 1, wvherein each introducing device has a housing, a fluid gate, and a fluid gate chamber disposed within the housing, the method further comprising:

receiving a working body in the fluid gate chamber when the working body is introduced into the liquid, and displacing the fluid gate chamber with the drive piston.

8. The method according to claim 1, wherein the method uses buoyancy and gravity of the working bodies to generate the rotational movement, further comprising:

receiving, within the liquid containers, the same liquid.

* * * * *